United States Patent [19]

Devale

[11] 4,437,499

[45] Mar. 20, 1984

[54] COMPUTER CONTROLLED SENSOR FOR BEVERAGE DISPENSER

[75] Inventor: Donald Devale, Sycamore, Ill.

[73] Assignee: Everpure, Inc., Westmont, Ill.

[21] Appl. No.: 262,129

[22] Filed: May 11, 1981

[51] Int. Cl.[3] ..... B65B 1/42

[52] U.S. Cl. ..... 141/95; 141/198; 141/360

[58] Field of Search ..... 222/638, 639, 640, 641, 222/643, 642, 373; 338/32 H; 330/6; 141/362, 360, 351, 198, 94, 95, 96, 367, 368

[56] References Cited

U.S. PATENT DOCUMENTS

| | | | |
|---|---|---|---|
| 3,265,099 | 8/1966 | Severino et al. . | |
| 3,272,217 | 9/1966 | Young . | |
| 3,273,752 | 9/1966 | Horeczky . | |
| 3,310,203 | 3/1967 | McCann . | |
| 3,349,881 | 10/1967 | Camp . | |
| 3,666,143 | 5/1972 | Weston . | |
| 3,823,846 | 7/1974 | Probst . | |
| 3,895,738 | 7/1975 | Buchanan et al. . | |
| 3,916,963 | 11/1975 | McIntosh . | |
| 3,976,222 | 8/1976 | Spagnolo . | |
| 4,040,457 | 8/1977 | Niese et al. . | |
| 4,162,028 | 7/1979 | Reichenberger | 222/129.4 |
| 4,202,387 | 5/1980 | Upton | 222/23 X |
| 4,218,626 | 8/1980 | Fukuda et al. | 338/32 H |
| 4,252,253 | 2/1981 | Shannon | 222/129.4 X |
| 4,265,371 | 5/1981 | Desai et al. | 222/639 |
| 4,276,999 | 7/1981 | Reichenberger | 222/129.4 |

FOREIGN PATENT DOCUMENTS 938442 10/1963 United Kingdom .

*Primary Examiner*—Stanley H. Tollberg

*Attorney, Agent, or Firm*—Hill, Van Santen, Steadman & Simpson

[57] ABSTRACT

A computer controlled sensor for a beverage dispenser in which a micro-processor receives inputs from one or more sensors for detecting the size of a beverage cup which is to be filled by a dispensing unit and which, depending upon the size of the cup, energizes a dispensing valve so as to fill either a small, medium or large size cup for example. A memory is provided which controls the micro-processor in response to the detected size of cup which is to be filled and a Hall sensor is utilized for initially setting the quantity of liquid which is to be dispensed.

1 Claim, 3 Drawing Figures

COMPUTER CONTROLLED SENSOR FOR BEVERAGE DISPENSER

BACKGROUND OF THE INVENTION

1. Field of the Invention

This invention relates in general to dispensing mechanism and, in particular, to a dispenser which is controlled by a mirco-processor.

2. Description of the Prior Art

Liquid dispensing units are known which include a plurality of sensors for detecting the size of a cup which is to be filled and, depending upon which cup is placed on the dispenser, automatically fills the cup and turns off the dispenser. Such prior art dispensers have utilized timing circuits of the resistive capacity type and have required a large number of components so as to properly control the dispensing unit.

SUMMARY OF THE INVENTION

The present invention relates to an automatic dispensing unit which is controlled by a micro-processor such that inputs from cup size detectors are supplied to the micro-processor and wherein the micro-processor is connected to a memory in which information is stored for determining how long the dispensing valve should be open for cups of different sizes. There is also provided means for initially storing in the memory information for controlling the dispensing valve for different size cups.

The present invention eliminates many components of prior art automatic dispensing units and the key component of the present invention is a micro-processor which receives inputs from the cup sensors and which controls a dispensing valve for automatically dispensing liquid or other substances.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and which:

DESCRIPTION OF THE PREFERRED EMBODIMENTS

Figure 1:
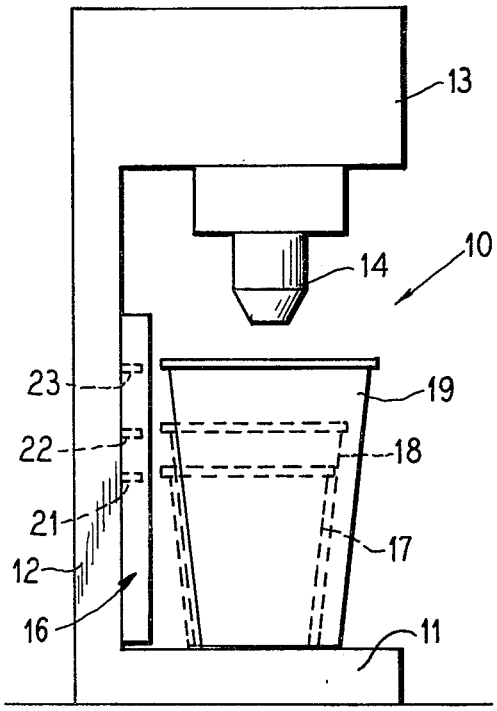
FIG. 1 is a side plan view of a dispenser according to the invention.

FIG. 1 illustrates a dispenser 10 which has a base 11 and an upright support 12 which is connected to an upper portion 13 to which a dispensing spout 14 is attached. The dispensing unit 10 is capable of automatically filling cups of different sizes such as illustrated small cup 17, medium size cup 18 and large cup 19 on the base 11 beneath the dispensing nozzle 14. A sensing unit 16 includes a small cup sensor 21, a medium size cup sensor 22 and a large size cup sensor 23.

Figure 2:
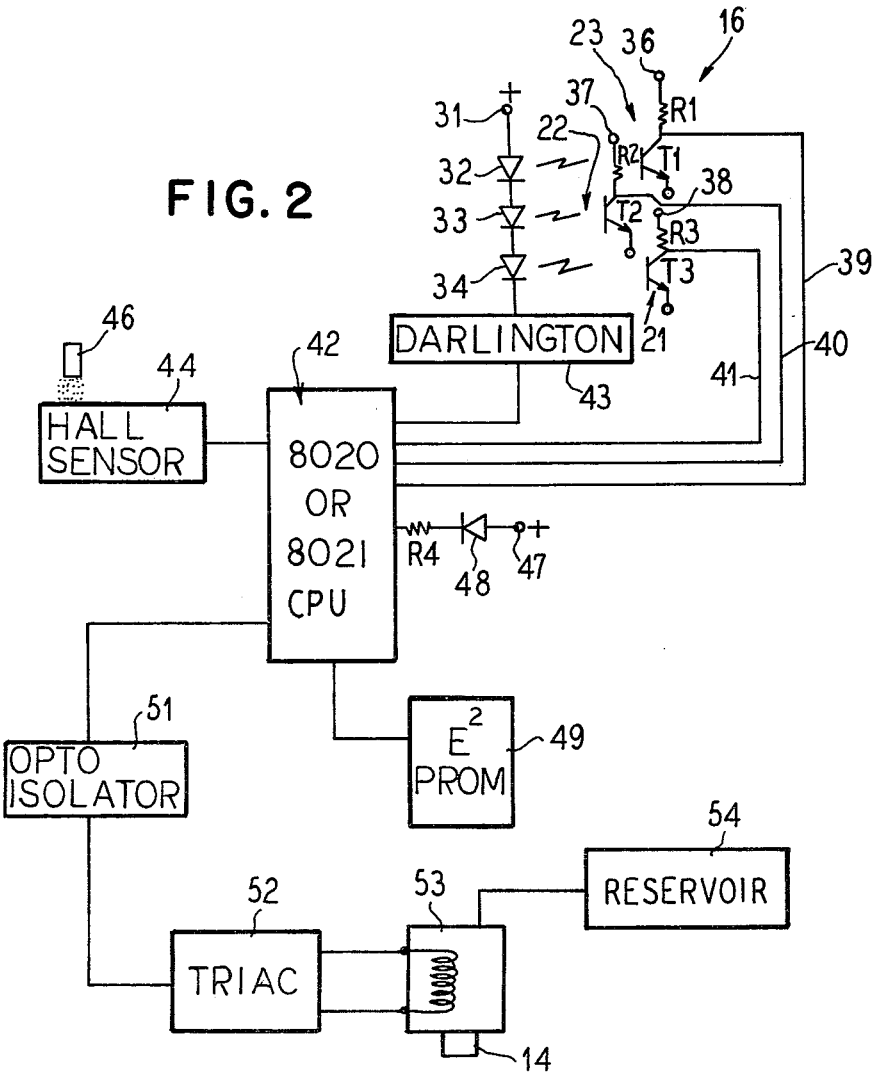
FIG. 2 is an electrical block diagram of the invention.

As is shown in FIG. 2, each of the sensors comprise a diode 32, 33 and 34 for emitting pulsed radiant energy which is detected by detectors 21, 22 and 23. A positive voltage is applied to a terminal 31 and the diodes 32, 33 and 34 are connected in series, and to a Darlington circuit 43 which is connected to the micro-processor 42.

The sensor 21 comprises the resistor R3 which has one side connected to terminal 38 and the other side connected to a detecting transistor T3 and an input is supplied on lead 41 to the micro-processor 42 from the sensor 21 when a small cup is placed on the base 11. The sensor 22 includes an input terminal 37, a resistor R2 and a transistor T2 which has one of its electrodes connected to a conductor 40 which supplies an input to the microprocessor 42. The sensor 23 includes an input terminal connected to a resistor R1 which has its other side connected to a sensing transistor T1 and a lead 39 supplies output from the sensor 23 to the micro-processor 42. A memory 49 of the $E^2$ PROM type as shown in the drawing is connected to the micro-processor 42. A program light 48 is connected to the micro-processor through a resistor R4 and has an input power terminal 47 for energizing the light 48. A Hall sensor 44 is connected to the micro-processor 42 and can be energized by a permanent magnet 46.

An optoisolator 51 is connected to the output of the micro-processor 42 and supplies an input to a triac 52 which is connected to a valve 53 which is energized by the triac to provide liquid from a reservoir 54 through the dispensing nozzle 14.

In operation, in order to program the computer 42 and to store the proper information in the memory 49, a small cup 17 is placed on the stand 11 and the sensor 21 detects the presence of the small cup 17 and supplies a signal on lead 41 to the micro-processor 42. The micro-processor 42 energizes the valve 53 through the isolator 51 and the triac 52 so that beverage is dispensed from the container 54 to the small cup 17. The first time that the dispensor is energized, the operator holds a magnet 46 in the vicinity of the Hall sensor 44 for a time depending upon the time required to fill the small cup 17 to the desired level. When the cup 17 is filled to the desired level, the operator moves the magnet 46 away from the Hall sensor 44 which then turns off the triac 52 and the valve 53 so that the cup will not be overfilled. The time of filling the small cup is stored in the memory 49 so that in subsequent operations when a small cup 17 is placed on the stand 11 the micro-processor will determine from the memory 49 the time required for filling the small cup 17 and will energize the dispensing valve 53 for such time.

Then a medium size cup 18 is placed on the stand 11 and the sensors 21 and 22 will both be energized and will provide on leads 40 and 41 inputs to the micro-processor 42. The operator will hold the magnet 46 adjacent the Hall sensor 44 for a time until the amount of beverage dispensed by the dispensor fills the medium size cup 18 to the desired level at which time the operator will remove the magnet 46 from the vicinity of the Hall sensor 44 and the valve 53 will be turned off by the micro-processor. The medium size cup fill time will also be stored in the memory 49 subsequent to this initial operation and, subsequently, when the sensors 21 and 22 detect the medium size cup, the dispensor will dispense a sufficient quantity of the beverage to fill the medium size cup.

Then a large cup 19 is placed on the stand 11 and the sensors 21, 22 and 23 will detect such large cup and will provide input on leads 39, 40 and 41 to the micro-processor 42 which will then fill the large cup. During the initial fill of the large cup, the operator will hold the magnet 46 adjacent the sensor 44 until the large cup has received sufficient desired liquid after which the operator will remove the magnet 46 from the vicinity of the Hall sensor 44 and such time will be stored in the memory 49.

At all subsequent times when either a small, medium or large size cup is placed on the stand 11, the associated sensors will detect the size of the cup which will be supplied on the leads 39, 40 and 41 to the micro-processor 42 which will then, based on the stored information in the memory 49, energize the valve 53 for time sufficient to fill either the large, small or medium size cup.

Figure 3:
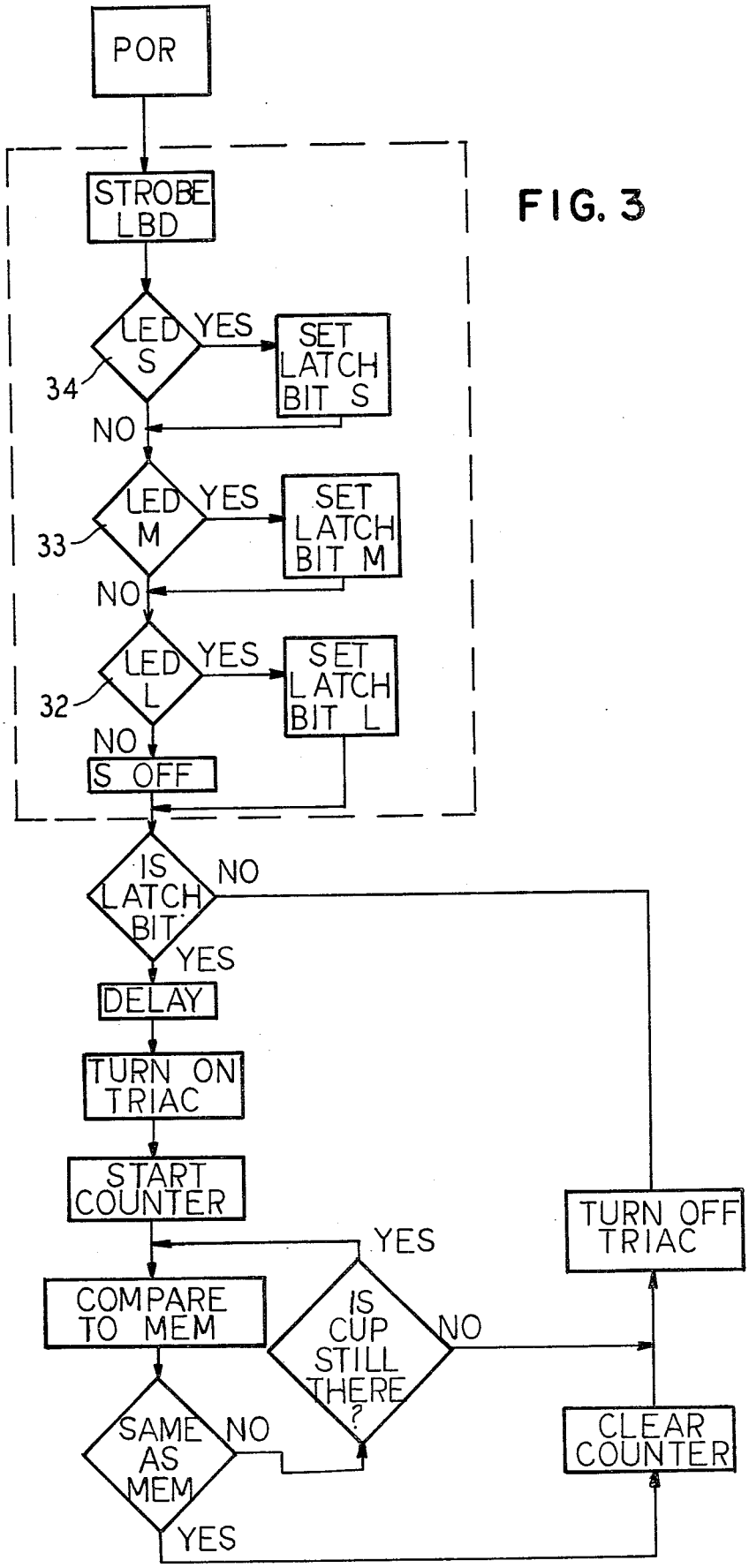
FIG. 3 is a flow diagram illustrating the operation of the invention.

FIG. 3 is a flow diagram of the micro-processor 42 and shows the LED's 34, 33 and 32 associated with the small, medium and large cup diodes which can be light omitting diodes and, if only the small sensor 34 is energized, the latch bit will reset to the small size cup. If both the small and medium size sensors are energized, the latch bit will be set to the medium and if all three sensors are energized, the latch bit will be set to large. A delay is provided so that if someone just waves his hand accidentally in front of the sensors, the dispensing valve will not be energized. After the delay the triac 52 is turned on which causes the dispensing valve 53 to be opened to dispense liquid into the cup. This also starts the counter for determining the time of dispensing and the output of the counter is compared to the stored count in the memory which determines how long the dispensing should occur. When the counter has counted to a time which is the same as the time stored in the memory, the triac will be turned off to discontinue further dispensing at that time.

Although the invention has been described with respect to preferred embodiments it is not to be so limited as changes and modifications can be made which are within the full intent and scope as defined by the appended claims.

I claim as my invention:

1. An automatic dispenser for small, medium and large cups including, a stand on which the cups can be placed, small, medium and large sensors mounted on the stand to sense small, medium and large cups, a microprocessor electrically connected to said small, medium and large sensors to receive electrical signals therefrom, and a dispensing valve mounted so as to dispense beverage into said cups connected to said microprocessor and controlled thereby, including an electrical eraseable memory connected to said microprocessor for storing information as to the time required to fill the small, medium and large cups, including means for establishing the time to respectively fill the small, medium and large cups connected to said micro-processor, and said means for establishing the time to fill comprises a Hall sensor connected to said micro-processor and responsive to a magnet.

* * * * *